US012667170B2

(12) United States Patent
Jaliwala

(10) Patent No.: US 12,667,170 B2
(45) Date of Patent: Jun. 30, 2026

(54) SEGMENTED ROLL RESISTANT NECKLACE SYSTEM

(71) Applicant: Jewelex New York, Ltd., New York, NY (US)

(72) Inventor: Khaiyam Jaliwala, Mumbai (IN)

(73) Assignee: Jewelex New York, Ltd., New York, NY (US)

( * ) Notice: Subject to any disclaimer, the term of this patent is extended or adjusted under 35 U.S.C. 154(b) by 0 days.

(21) Appl. No.: 18/602,378

(22) Filed: Mar. 12, 2024

(65) Prior Publication Data

US 2024/0306778 A1 Sep. 19, 2024

Related U.S. Application Data

(60) Provisional application No. 63/452,856, filed on Mar. 17, 2023.

(51) Int. Cl.
*A44C 5/10* (2006.01)
*A44C 15/00* (2006.01)

(52) U.S. Cl.
CPC ..... *A44C 15/005* (2013.01)

(58) Field of Classification Search
CPC ..... A44C 15/005; A44C 5/2076; A44C 5/10; A44C 5/102; A44C 5/105; A44C 5/107; A44C 11/007; A44C 5/00; A44C 5/02; A44C 11/00; A44C 13/00; F16G 15/12
USPC ..... 59/80, 82, 90, 91, 92
See application file for complete search history.

(56) References Cited

U.S. PATENT DOCUMENTS 214,075 A * 4/1879 Alden ..... A44C 11/00 59/83
1,344,365 A * 6/1920 Wachenheimer ..... A44C 5/102 63/4
1,573,927 A * 2/1926 Fulford ..... A44C 11/007 63/26
1,589,423 A * 6/1926 Payton ..... A44C 11/007 63/26
1,591,815 A * 7/1926 Girdany ..... A44C 5/10 16/221
1,621,287 A * 3/1927 Speidel ..... A44C 11/007 152/243
1,728,266 A * 9/1929 Fassnacht ..... A44C 11/007 63/26
1,814,792 A * 7/1931 Engel ..... A44C 5/107 63/4
1,831,951 A * 11/1931 Fassnacht ..... A44C 5/107 D11/19
2,143,703 A * 1/1939 Kestenman ..... A44C 5/107 D11/15
2,584,207 A * 2/1952 Holl ..... A44C 11/007 63/4

(Continued)

*Primary Examiner* — Jason W San
*Assistant Examiner* — Anna S Rashid
(74) *Attorney, Agent, or Firm* — Andrew F. Young, Esq.; NOLTE LACKENBACH SIEGEL

(57) ABSTRACT

A segmented roll resistant necklace system includes a plurality of selected link elements interfitted along a cephalo-caudal (top-to-bottom) length in designated sections to accommodate a relative pivot motion between each adjacent link about a defined link pivot axis and to prevent a relative rotation between adjacent links away from each defined pivot axis in series thereby resisting roll along a necklace long pivot axis of the necklace system.

7 Claims, 13 Drawing Sheets

(56) References Cited

U.S. PATENT DOCUMENTS 2,634,593 A * 4/1953 Moretti ..... A44C 11/007 24/616
3,425,214 A * 2/1969 Meng ..... A44C 5/107 59/91
3,436,907 A * 4/1969 Behar ..... A44C 5/105 59/95
3,482,394 A * 12/1969 East ..... A44C 5/107 59/80
5,339,655 A * 8/1994 Grando ..... A44C 5/102 63/26
5,343,718 A * 9/1994 Poll ..... A44C 11/007 63/26
5,592,835 A * 1/1997 Herr ..... A44C 11/007 63/4
5,774,957 A * 7/1998 Kohl ..... A44C 5/2057 24/616
6,418,706 B1 * 7/2002 Kit ..... A44C 5/10 63/4
7,007,508 B1 * 3/2006 Valentini ..... A44C 5/105 63/3
8,156,759 B2 * 4/2012 Nevatia ..... A44C 5/102 63/3
9,010,147 B2 * 4/2015 Barbazza ..... A44C 5/06 63/38
9,622,553 B2 * 4/2017 Lauren ..... A44C 11/00
9,816,585 B1 * 11/2017 Dreixler ..... F16G 13/12
D873,703 S * 1/2020 Borsari ..... D11/86
10,881,172 B1 * 1/2021 Straus ..... A44C 13/00
11,160,336 B2 * 11/2021 Yurman ..... A44C 5/022
12,310,466 B2 * 5/2025 Koçhisarli ..... A44C 11/007
2002/0184915 A1 * 12/2002 Avakian ..... A44C 5/107 63/9
2002/0194867 A1 * 12/2002 Akyol ..... A44C 15/0025 63/3
2004/0103689 A1 * 6/2004 Chia ..... A44C 11/007 63/26
2005/0210918 A1 * 9/2005 Fufuangvanich .... A44C 11/007 63/28
2007/0044511 A1 * 3/2007 Marco ..... A44C 5/022 63/38
2009/0151393 A1 * 6/2009 Spigner ..... A44C 9/003 63/3.1
2010/0024483 A1 * 2/2010 Nevatia ..... A44C 5/102 29/11
2010/0192630 A1 * 8/2010 Sorenson ..... A44C 5/105 63/3
2014/0000313 A1 * 1/2014 Barbazza ..... A44C 13/00 63/4
2016/0192745 A1 * 7/2016 Lauren ..... A44C 5/105 59/89
2016/0316864 A1 * 11/2016 Cluseau ..... A44C 27/00
2017/0311685 A1 * 11/2017 Yamakawa ..... A44C 5/107
2021/0015219 A1 * 1/2021 Bonfante ..... A44C 11/007
2021/0244139 A1 * 8/2021 Yurman ..... A44C 25/007
2024/0008599 A1 * 1/2024 Cluzeau ..... A44C 5/02
2025/0031812 A1 * 1/2025 Koçhisarli ..... A44C 11/007

* cited by examiner

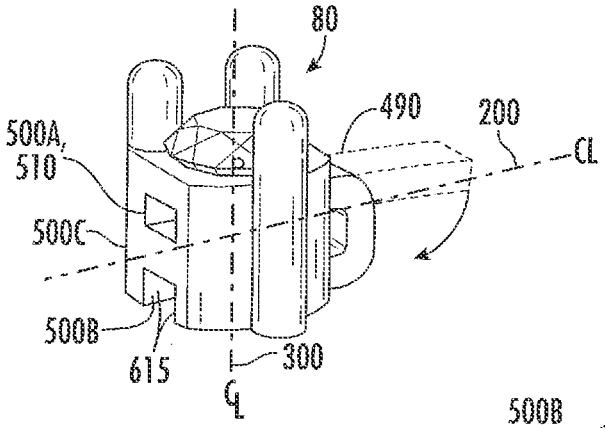
FIG. 9A
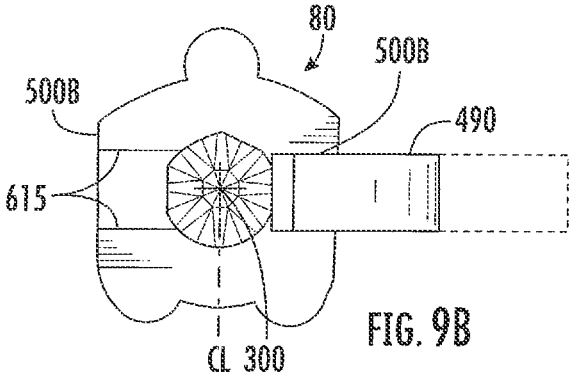
FIG. 9B
FIG. 9C
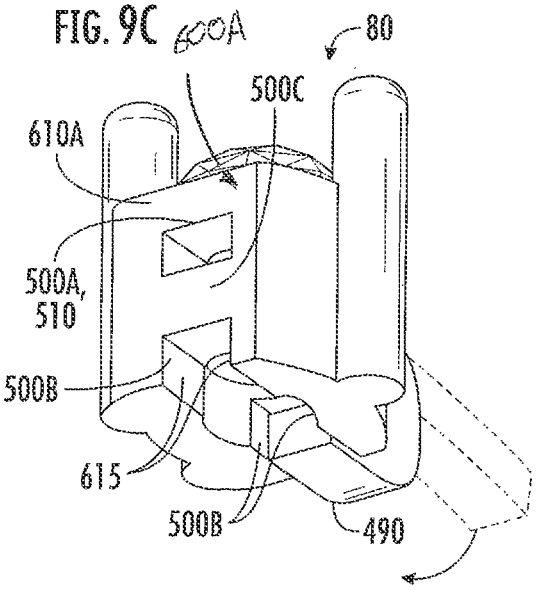
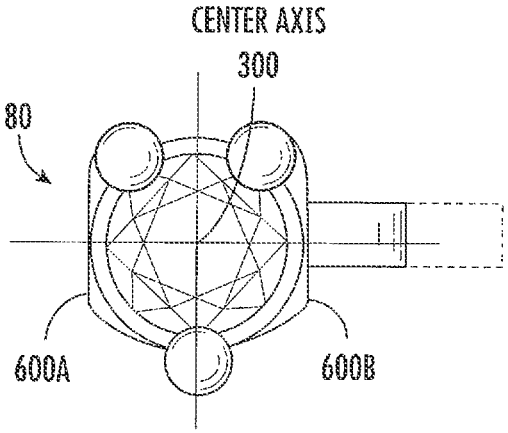
FIG. 9D

SEGMENTED ROLL RESISTANT NECKLACE SYSTEM

CROSS REFERENCE TO RELATED APPLICATIONS

This application relates to, and claims priority from, U.S. Provisional Ser. No.: 63/452,856 filed Mar. 17, 2023, the entire contents of which are incorporated herein by reference.

FIGURE SELECTED FOR PUBLICATION

FIG. 4.

BACKGROUND OF THE INVENTION

Field of the Invention

The present invention relates to a segmented roll resistant necklace system. More particularly, this invention relates to a segmented roll resistant necklace with a plurality of link elements interfitted to control a relative pivot motion between each respective adjacent link about a necklace pivot axis and to resist a relative rotation between each adjacent link away from each defined pivot axis in series in the system thereby resisting roll along a cephalocaudal (top-to-bottom) length of the necklace system.

Description of the Related Art

Conventional necklace systems with a plurality of segmented interconnected links allow easy relative rotation both laterally and radially relative to the next adjacent link along a long axis of the necklace. As a result, conventional segmented necklace systems allow continuous rotation and motion in three dimensions (X, Y, and Z) of one link relative to the next-link in line link. As a consequence, when a conventional segmented necklace is worn and draped on a user with a dynamic support profile (neck, collar bones, chest) the individual links of the conventional necklace rotate relative to each other and often fully invert (turn upside down) on a user or potentially fully rotate (360 degrees) along a necklace long axis providing an unattractive (and uncontrolled) visual appearance. Such difficulties in the hanging and easy rolling of conventional necklaces allow intermittent display of stones or decorative indicia on a top-side (between roll-pivots) and also detrimental intertwining entanglement with fabric, hair, lace or other jewelry items, risking damage and being difficult to untangle.

Referring now to FIGS. 1, 2, and 3, a conventional segmented necklace 1000 is illustrated in a conventional hanging arc curve (FIG. 1) and noted under the influence of gravitational (weight) hanging around a neck geometry (FIG. 2). A dynamic conventional illustration (FIG. 3) notes the three general sections for a hanging necklace on a human geometry. As noted there is a curve section (around a user's neck), which transitions to a bend section (from about a collar-bone region to a hanging region), and a final hang and curve section there below (wherein the necklace joins and follows in a curve along a user's chest region from side to side forming a continuous loop).

As illustrated in FIG. 3, the stresses on a conventional segmented necklace 1000, with continuous common links along an entire length, undergoes a pulling (in the curve section) relative to a user, a roll and a rotation force (as the necklace falls along the collar bone (in a bend section), and a further twist inducement (see image) on either side of the bend section (in the hang and curve section) as the conventional segmented necklace attempts to accommodate the roll and bend and curve motions and rotates along the long necklace axis one or more times. As a result, those of skill in the art readily appreciate that conventional bending motion and rotation forces developed in the collar bone/bend section (and related transitions through curve section and hanging sections) result in partial or full rotation (or multiple segment multi-rotations) along the cephalocaudal (top-to-bottom) length of a conventional necklace. As noted below, the phrase cephalocaudal is used descriptively for an elongated, multi-segmented, joined-together-segment system from one end to another (either elongated or joined together in a loop from a top to a bottom).

The present invention attempts to address at least one, and preferably more than one, of the concerns noted herein above.

ASPECTS AND SUMMARY OF THE INVENTION

The present invention responds to at least one of the concerns noted above.

According to one alternative aspect of the present invention, there is provided a segmented roll resistant necklace system that includes a plurality of selected link elements interfitted along a cephalocaudal (top-to-bottom) length in designated sections to accommodate a relative pivot motion between each adjacent link about defined link pivot axes and to prevent a relative rotation between adjacent links away from each defined pivot axis in series thereby resisting roll along the length axis of the necklace system.

According to another alternative aspect of the present invention, there is provided a segmented roll resistant necklace assembly, as shown and described.

According to another alternative aspect of the present invention, there is provided a segmented roll resistant necklace assembly, comprising: a clasp arrangement having a first clasp end and a second clasp end, a plurality of pull links secured to each the clasp end and extending away from the clasp arrangement to a respective transition assembly, each the transition assembly, further comprising: a converter link connected to an end of the plurality of pull links, a dual link connected to the converter link, and a plurality of ring links connecting each respective the dual link on each the transition assembly thereby forming the necklace assembly.

According to another alternative aspect of the present invention, there is provided a segmented roll resistant necklace assembly, further comprising: a pull link clasp segment on each of the first clasp end and the second clasp end, and the plurality of pull links extending from respective the first clasp end and the second clasp end.

According to another alternative aspect of the present invention, there is provided a segmented roll resistant necklace assembly, wherein: each pull link, further comprises: a brace hole on a first pull link contact side, and a cantilever bar arm on a second pull link contact side.

According to another alternative aspect of the present invention, there is provided a segmented roll resistant necklace assembly, wherein: each converter link, further comprises, a cantilever slot brace stub on a first converter link contact side, and a cantilever bar arm on a second converter link contact side.

According to another alternative aspect of the present invention, there is provided a segmented roll resistant necklace assembly, wherein: each dual link, further comprises: a first cantilever slot arm extending on a first dual link contact side, and a second cantilever slot arm extending on a second dual link contact side.

According to another alternative aspect of the present invention, there is provided a segmented roll resistant necklace assembly, wherein: each ring link, further comprises: a cantilever slot brace stub on a first ring link contact side, and a cantilever bar arm on a second ring link contact side.

The above and other aspects, features and advantages of the present invention will become apparent from the following description read in conjunction with the accompanying drawings, in which like reference numerals designate the same elements.

BRIEF DESCRIPTION OF THE DRAWINGS

FIGS. 5A and 5E are perspective views of the clasp assembly in a closed and an open position noting engagement. FIG. 5B is a top view. FIG. 5C is a front side view. FIG. 5D is a sectional view along section 5D-5D shown in FIG. 5C.

FIG. 6A is a front top perspective view of a ring link. FIG. 6B is a bottom rear perspective view of a ring link as in FIG. 6A. FIG. 6C is a rear top perspective view of a ring link. FIG. 6D is a front top right side view of a ring link. FIG. 6E is a front elevation view. FIG. 6F is a top plan view. FIG. 6G is a rear elevation view. FIG. 6H is a left side elevation view. FIG. 6I is a right side elevation view.

FIG. 7A is a front top perspective view. FIG. 7B is a top rear perspective view. FIG. 7C is a bottom rear perspective view. FIG. 7D is a top plan view. FIG. 7E is a front elevation view. FIG. 7F is a rear elevation view. FIG. 7G is a left side elevation view. FIG. 7H is a right side elevation view.

FIG. 8A is a front top perspective view of the converter link. FIG. 8B is a bottom rear perspective view. FIG. 8C is a further bottom rear perspective view. FIG. 8D is a top plan view. FIG. 8E is a front elevation view. FIG. 8F is a rear elevation view. FIG. 8G is a bottom plan view.

FIGS. 9A to 9H illustrate an exemplary pull link segment used to join a clasp arrangement and related transition assembly elements in an exemplary segmented roll resistant necklace for the proposed invention. FIG. 9A is a front top perspective view. FIG. 9B is a bottom plan view. FIG. 9C is a front bottom perspective view. FIG. 9D is a top plan view. FIG. 9E is a right side elevation view. FIG. 9F is a front elevation view. FIG. 9G is a rear elevation view. FIG. 9H is a rear bottom perspective view.

DETAILED DESCRIPTION OF THE PREFERRED EMBODIMENTS

Figure 1:
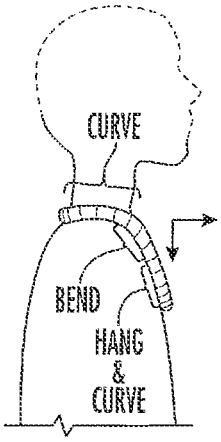
FIG. 1 PRIOR ART
FIGS. 1, 2, and 3 represent illustrative graphics of a conventional segmented necklace within an illustrated construct of a user noting the curve, bending and rolling influence upon links in a segmented conventional necklace.
Figure 2:
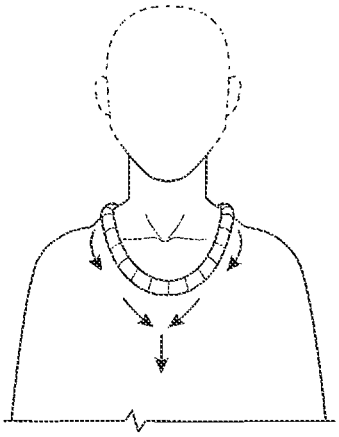
FIG. 2 PRIOR ART
Figure 3:
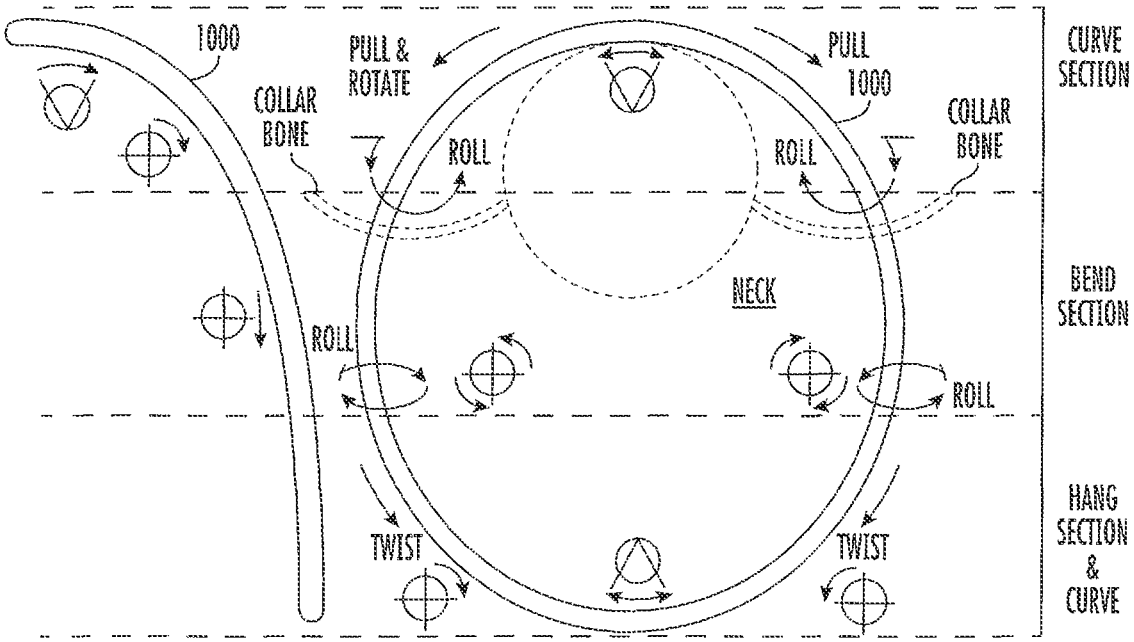
FIG. 3 PRIOR ART
Figure 4:
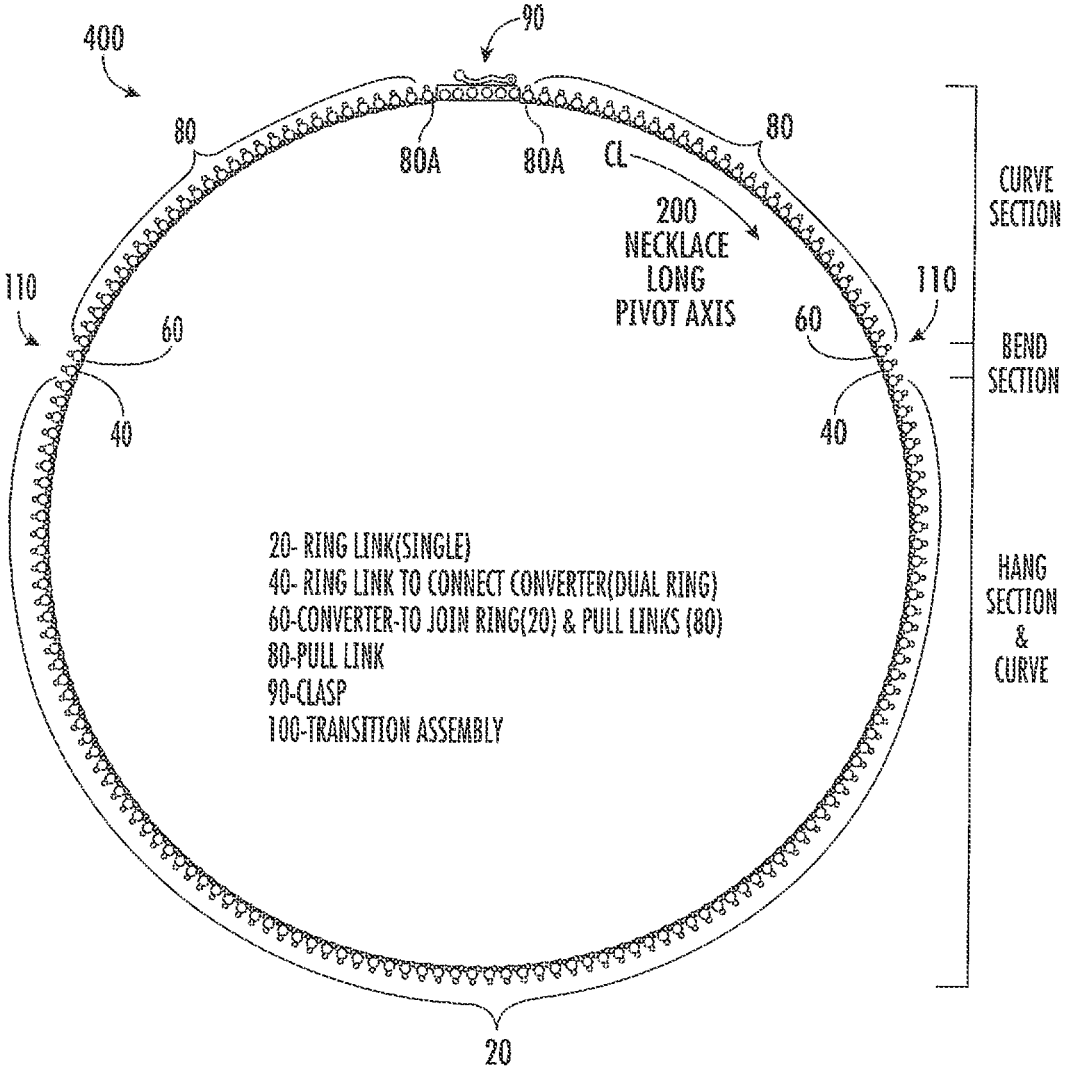
FIG. 4 is an illustrative view of an exemplary segmented roll resistant necklace noting sectional portions.
Figure 5A:
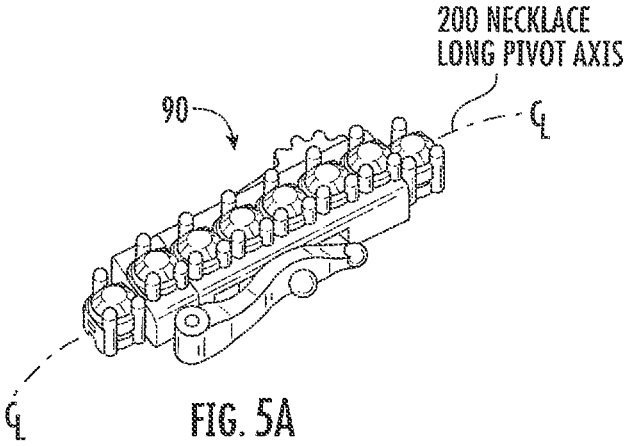
FIGS. 5A, 5B, 5C, 5D, and 5E provide illustrative views of an exemplary clasp arrangement segment for the proposed invention.
Figure 5B:
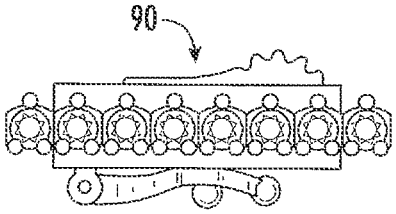
Figure 5C:
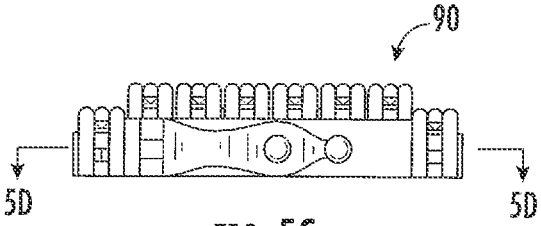
Figure 5D:
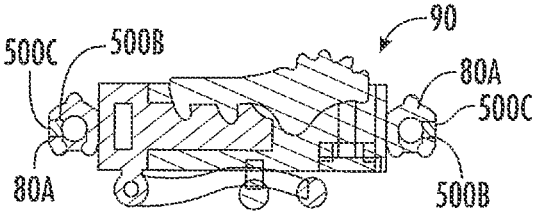
Figure 5E:
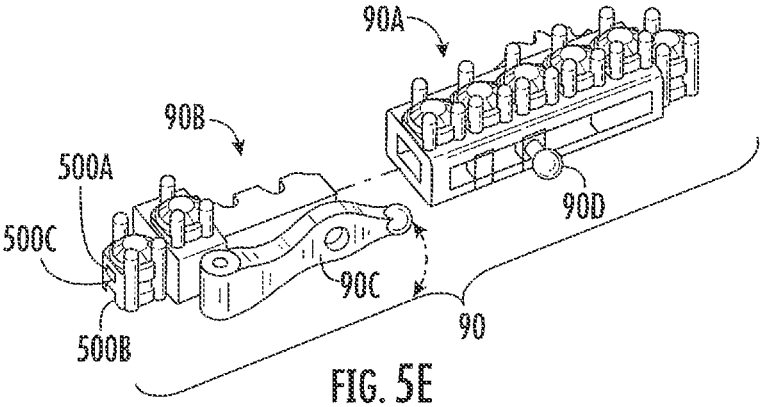

Reference will now be made in detail to embodiments of the invention. Wherever possible, same or similar reference numerals are used in the drawings and the description to refer to the same or like parts or steps. The drawings are in simplified form and are not to precise scale. The words 'couple' or 'join' or 'secure' and similar terms do not necessarily denote direct and immediate connections, but also include connections through intermediate elements or devices. For purposes of convenience and clarity only, directional (up/down, etc.) or position (top/bottom/side) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Referring now to FIGS. 4 through 10E a segmented roll resistant necklace 400 having a necklace long pivot axis 200 and a plurality of segment elements is shown (FIG. 4) defining an upper curve section, a bend section, and a hang and curve section as will be discussed.

Segmented roll resistant necklace 400 contains a clasp arrangement segment 90 joined to a plurality of individual pull links 80, respective converter links 60, dual ring links 40 and a plurality of ring links 20, as shown. A transition assembly 110 (see FIG. 10A) is shown referring to the transition on each side of necklace 400 from a respective pull link 80, a respective converter link 60, a respective dual ring link 40 to a respective ring link 20 on the other side thereof, as will be discussed herein below.

Clasp arrangement 90 includes a female portion 90A and a male portion 90B including a pivot lock bar 90C enjoining a lock protuberance 90D. On either side of clasp arrangement 90 and affixed thereto is a pull link clasp segment portion 80A, joined with respective female portion 90A and male portion 90B, as shown, and without a projecting stub brace (as will be shown later in the individual pull links 80 (see FIGS. 9A-9H). As a result, each pull link clasp segment 80A includes a brace hole 500A, a partial brace bottom slot 500B (a full brace bottom slot 500B with full brace bottom slot contact surfaces 610 is noted in pull link 80 FIGS. 9A to 9H), and a brace bar 500C that spans either side of partial brace bottom slot 500B forming brace hole 500A, as will be appreciated.

Transition link assembly 110 is positioned along segmented roll resistant necklace 400 aligned with necklace pivot axis (long axis) 200 proximate one-quarter to one-half of the side-arc of the necklace 400 (see FIG. 4) to approximate a user's support profile. As a result of the assembly system herein, and the use of transition link assembly 110, rotation along necklace long pivot axis 200 between respective links and along the entire length is effectively minimized and eliminated as will be discussed. Transition link assembly 110 is effective to transition from respective pull links 80 to respective ring links 20 to accommodate any rolling urge built up along the length of pull links 80 from clasp arrangement 90 thereby preventing any respective relative rotation along neck axis 200 (eliminating roll) while allowing suitable bend displacement between the respective links, each having a relative link short pivot axis 300 (see FIG. 10A and others), so as to allow segmented necklace 400 to transition from a curve section through a bend section to a hang and curve section.

Referring now to respective ring links 20 as noted throughout and in FIGS. 6A to 6I, wherein each ring link 20 has a short pivot axis 300 (between respective links 20) which is established perpendicular to the necklace pivot axis (long axis) 200. Ring links 20 include a link indicia platform 610A on a top side opposite a link support base 610B on a bottom side which includes a generally flat surface contact face (as shown, but may be in any form). As shown (FIG. 6A), a jewel is positioned on link indicia platform 610A in a preferred embodiment but the invention is not limited thereto and any form of indicia, or combinations of indicia, may be provided and will be understood as within the scope of the present disclosure. Examples of such indicia are jewels, multi-jewel-settings, and other decorative indicia. Each ring link 20 includes a first link contact surface 600A opposite a second link contact surface 600B (on the opposite side thereof). Each link contact surface 600A, 600B establishes a contact surface which is parallel to the link short pivot axis 300 and to the respective other contact surface of a respective link, whereby when links 20 are joined adjacent to each other (or to other links as discussed herein and below), the link contact surfaces 600A, 600B are in a guiding contact with one another, parallel to pivot axis 300 to resist a respective roll between respective links 20, 40, 60, 90, with respective short pivot axis 300, thereby collectively resisting a collective roll along segmented necklace 400 along necklace long pivot axis 200.

Each ring link 20 further includes a cantilever slot brace stub 460 extending from a cantilever brace side slot 470 extending through ring link 20 between link indicia platform 610A and link support base 610B. Cantilever brace side slot 470 has opposed side slot contact surfaces 450, as shown. Cantilever slot brace stub 460 extends on a plane parallel to necklace long pivot axis 200 and perpendicular to link short pivot axis 300, as well as perpendicular to first link contact side surface 600A. Generally, opposite cantilever slot brace stub 460 is a cantilever slot arm 480 that also extends from between link indicia platform 610A and link support base 610B along a plane parallel to necklace long pivot axis 200 and perpendicular to link short pivot axis 300. As shown in dashed-lining in FIGS. 6A to 6F, and 6H, cantilever slot arm 480 is initially formed as an elongated bar member (straight or slightly curved) having parallel top and bottom surfaces (shown) which, in an assembly, is position elongated and upon assembly with a co-ring-link 20 extends through slot 470 and around an adjacent cantilever slot brace stub 460 so that a distal end of cantilever slot arm 480 is secured within cantilever brace side slot 470 (for example, See FIG. 6B, 6C, 6H) such that side slot contact surfaces 450, 450 engage with the parallel top and bottom surfaces of cantilever slot arm 480 and also engage with cantilever slot brace stub 460 to prohibit relative rotation between adjacent ring links 20 along necklace long pivot axis 200 and maintain respective link support bases 610B along a general common plane via the engagement of the respective slot contact surfaces and contact side surfaces.

Referring now additionally to respective dual ring links 40 (See FIGS. 7A to 7F) wherein each dual ring link 20 as short pivot axis 300 perpendicular to the necklace pivot axis (long axis) 200. Dual ring links 40 include link indicia platforms 610 on a top side opposite the link support base 610 on the bottom side which includes a generally flat surface contact face (as shown, but may be in any form). As shown (FIG. 7A) a jewel is positioned on link indicia platform 610A in a preferred embodiment but the invention is not limited thereto, and any form of indicia may be provided and will be understood herein. Each dual ring link 40 includes respectively the first link contact surface 600A and the opposite second link contact surface 600B. As with ring link 20, each link contact surface 600A, 600B for dual ring link 40 establishes contact surfaces that are parallel to the short link pivot axis 300, whereby when dual ring link 40 is adjacent ring link 20 or converter 60 there is a guiding contact that resists a respective roll between respective links with respective short pivot axis 300 thereby collectively resisting a collective roll along segmented necklace 400 and along necklace long pivot axis 200.

A cantilever brace side slot 470 extends along the side of each dual ring link 40 between respective link indica platform 610A and link support base 610B, as shown. Opposing cantilever slot arms 480, 480 project away from cantilever slot brace side slot 470, as shown in various views to engage (upon bending-curving assembly) over and around respective cantilever slot brace stubs 460 of a ring link 20 or with a respective cantilever slot brace stub 460 of a converter link 60, as will be discussed. With bending, an end of each respective cantilever slot arm 480 wraps around respective brace stubs 460 and is received within cantilever brace side slot 470 and contacts respective side slot contact surfaces 450 forming a sliding-engagement that resists roll between respective ring links 20, converter links 60 and respective dual ring links 40.

Referring now additionally to respective converter links 60 (see FIGS. 8A to 8G) wherein each converter link 60 has short pivot axis 300 perpendicular to the necklace pivot axis (long axis) 200, as shown, and in common with the other links herein. As with the other links, converter links 60 include link indicia platforms 610 on a top side opposite the link support base 610 on the bottom side which includes a generally flat surface contact face (as shown, but may be in any form). As shown (FIG. 8A) a jewel is positioned on link indicia platform 610A in a preferred embodiment but the invention is not limited thereto, and any form of indicia may be provided and will be understood herein (such as carving, shiny or other indicia element). Each converter link 60 includes respectively the first link contact surface 600A and the opposite second link contact surface 600B formed for contact with respective contact surfaces 600A, 600B of other links in the assembly 400. As with ring link 20 and dual ring link 40 and pull link 80, each converter link 60 link contact surface 600A, 600B establishes contact surfaces that are parallel to the short link pivot axis 300 for converter link 60, whereby when converter link 60 is adjacent dual ring link 40 or pull link 80 in assembly 400 there is a guiding contact that resists a respective roll between respective links with respective short pivot axis 300 thereby collectively resisting a collective roll along segmented necklace 400 and along necklace long pivot axis 200.

As noted in FIGS. 8A to 8G, the cantilever brace side slot 470 extends along the side of each converter link 60 between respective link indica platform 610A and link support base 610B, as shown. A respective cantilever slot brace stub 460 projects away from cantilever slot side brace 470, as shown. A cantilever bar arm 490 projects separately away from link contact side 600B and away from cantilever slot brace side slot 470, oriented along necklace long axis 200, as shown in various views to engage (and upon bending-curving assembly with pull link 80) through and inwardly to a brace hole 500A, around a crossing brace bar 500C and then into and to be restrained within a brace bottom slot 500B with bar hole contact surfaces 615 (as shown in FIG. 9A) and as shown in the transition assembly 110 (FIGS. 10A to 10E). As a result, converter link 60 forms a converting transition from a side-bend-linking orientation (i) between cantilever slot brace stub 460 (of link 60) and cantilever slot arms 480 (of link 40) (as shown) in a direction perpendicular to the link short pivot axis 300 to an axial-bend-linking orientation (ii) between cantilever bar arm 490 (of link 60) and brace hole 500A and brace bar 500C (of link 80). In this manner converter link 60 aids in the formation of transition assembly 110 (FIG. 10A) and the bend section (see FIG. 4) of segmented necklace assembly 400. It will be understood that the respective contact surfaces and slots and holes are shaped to closely contact the respective cantilever slot arms 480, cantilever bar arms 490 and cantilever slot brace stubs 460 so as to prevent unintended relative rotation and misalignment of the respective links 20, 40, 60 and 80 to thereby prevent roll along the long axis 200.

Referring now to FIGS. 9A to 9H, pull link 80 joins converter links 60 with respective pull link clasp segments 80A (See FIG. 5D) of clasp arrangement segment 90. As shown, pull link 80 has respective top link indicia platform 610A and link support base 610B as noted earlier along with first and second link contact sides 600A, 600B, as shown. On a first link contact side 600A is formed brace hole 500A, by brace bar 500C spanning brace bottom slot 500C. Brace hole 500A includes bar hole contact surfaces 510 (the side walls) and brace bottom slot 500B includes brace bottom slot contact surfaces 615 as shown. During an assembly step, a cantilever bar arm 490, extending from converter link 60, passes through brace hole 500A on the first link contact side surface 600A, and is bent around brace bar 500C so that a distal end of cantilever bar arm 490 is restrained within brace bottom slot 500B and engages with respective brace bottom slot contact surfaces 615 and respective bar hole contact surfaces 510 in a male-female arrangement as shown. Opposite brace hole 500A, on the second link contact side 600B extends cantilever bar arm 490, which in turn (during assembly) is restrained within respective brace holes 500A in further pull links 80 (or at an end into and through a brace hole 500A in respective pull link clasp segments 80A) to join with clasp arrangement 90. This way, the change in side-bend/axial-bend curve orientation that occurred during transition assembly 110 is maintained from transition assembly 110 to clasp arrangement 90.

During the transitions as noted, the respective first link contact side surfaces 600A and second link contact sides 600B are in contact with each other and prevent (in combination with the other joining structures) unintended relative rolling between respective links in the assembly 400 along the long pivot axis 200. In this manner, the links in assembly 400 provide the segmented roll resistant necklace. 400.

Referring additionally to illustrated transition assembly 110 (See FIGS. 10A to 10E) wherein an assembly of links (ring link 20, dual ring link 40, converter link 60, and pull link 80) is provided. As will be understood by those of skill in this art having studied and appreciated the disclosure herein, the respective link contact side surfaces 600A, 600B are in close contact upon respective assembly of the links, and each provides a flat plane contacting the other that is also aligned in parallel with respective link short pivot axis 300 and restrain a pitch (or a bend) between the relative adjacent link short pivot axis 300 and thus restrain bend between each link unless guided by the specified assembly to prevent roll.

Figure 10A:
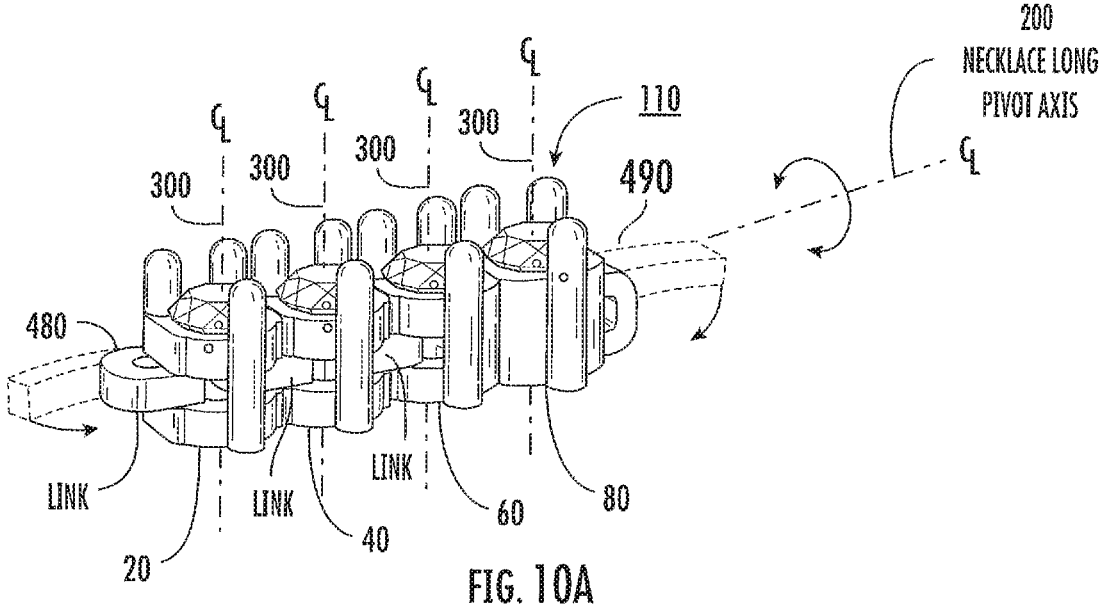
FIGS. 10A to 10E illustrate an exemplary transition assembly containing an exemplary ring link, an exemplary dual ring link, an exemplary converter link, and an exemplary pull link in an exemplary segmented roll resistant necklace for the proposed invention.
Figure 10B:
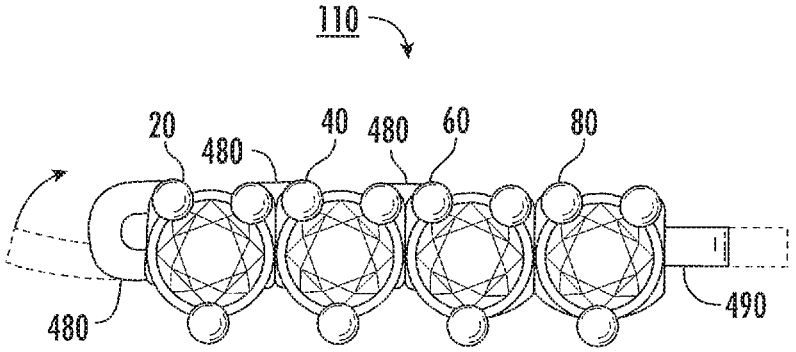
Figure 10C:
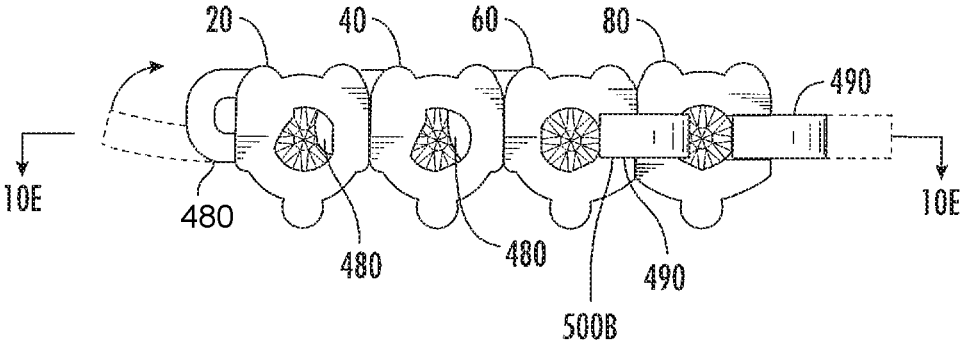
Figure 10D:
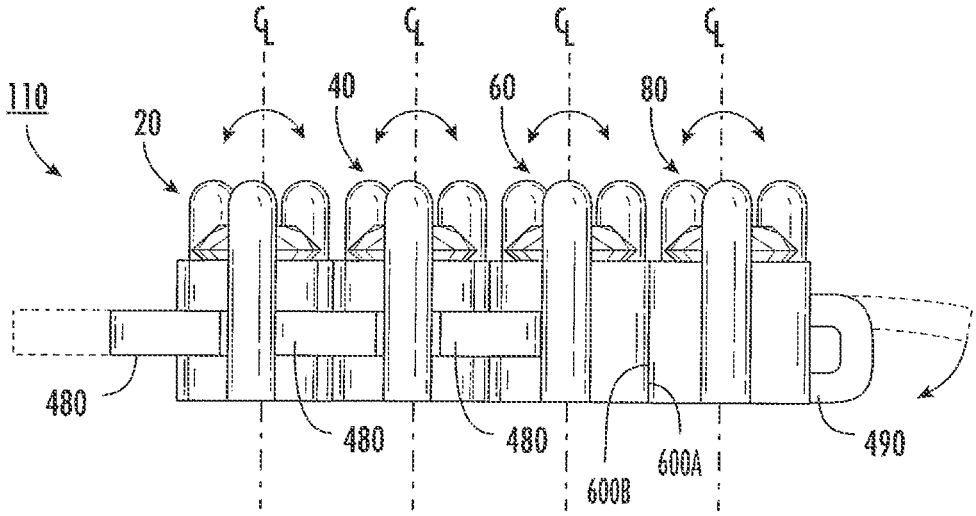
Figure 10E:
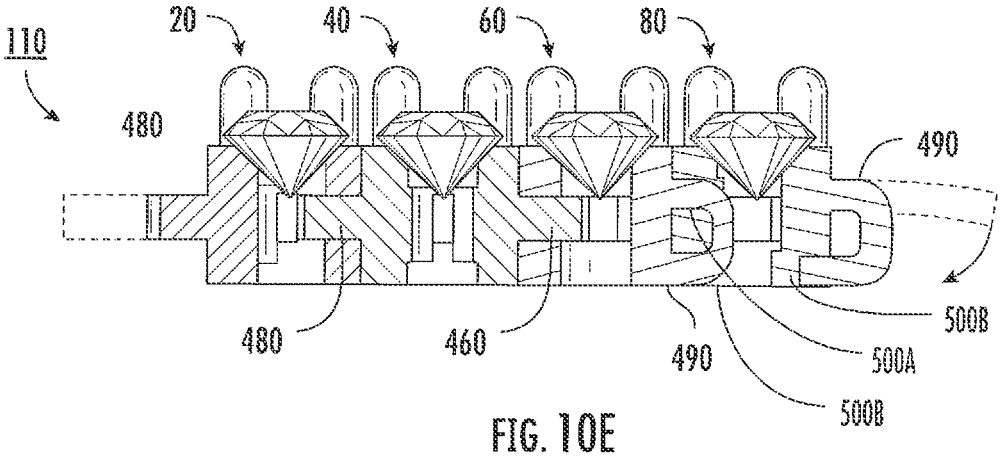

As can be further appreciated in view of FIGS. 10D and 10E, the cantilever slot arm 480 controls and prevents unintended axial bend linking between ring links 20, dual links 40, and converter links 60 while pull links 80 with the transition using brace hole 500A and cantilever bar arm 490 enable a slight axial bend (with respective short pivot axis 300, proximation the locations linking in the curve section (FIG. 4) of the assembly 400; and as a result the entire assembly 400 prevents rolling along the long axis 200 as the necklace 400 undergoes draping/hanging.

It will be understood by those of skill in the art, having studied and appreciated the disclosure herein, that the jewel/stone shown in the views along the top side of respective links, assemblies, and features is not restrictive, and may represent one or a plurality of jewels/stones in one or a combination of one or more sizes or types, or one or more other decorative indicia (polished/engraved/shaped surface) so as to enhance the visual appearance of the segmented roll resistant necklace system without restriction to the particular jewel, stone, decorative indicia, or optionally the need for the same to rest with the scope and spirit of the entire disclosure herein.

It will be recognized that the similar sections, grooves, assembly elements, and systems are operable in these additional embodiments, including forms in mirror images (left-to-right-mirror for links (for example pull links 80 may be inverted depending on either side of clasp arrangement 90 etc.)) of each element or each section and are within those of skill in this art having studied and appreciated the present disclosure and resting within the scope and spirit of the entire disclosure. As a result, those of skill in this art, having appreciated and studied the present disclosure will recognize that the respective links (ring, dual ring, converter, pull, center, pull link clasp segments, clasp arrangement, transition assemblies or otherwise) may be provided in a plurality of arrangements without limitation including in left-or-right orientation and in respective versions to accommodate the inventive goals herein. Accordingly, such roll resistant systems may be of variable lengths and corresponding contours to achieve the roll-resistant-arrangements envisioned by the present disclosure.

The phrase cephalocaudal is used mechanically-descriptively for an elongate, multi-segmented, joined-together-segment system from one end with a clasp to another end joining the clasp (either elongated or joined together in a loop from a top to a bottom in the loop). Therefore, the phrase cephalocaudal shall not be restricted to any specific or any medical use, but instead linguistically represents the respective transition length along the elongated (long) and multi-segmented (including looped) axis of the multi-segmented flexible necklace from a beginning to an end (whether or not joined at a connecting clasp). Therefore, as used herein, starting from either side of the clasp, it will be understood by those of skill in the art having studied the enclosed details and elements, that the present system is roll-resistant along the cephalocaudal length (long-axis length beginning to end) of the multi-segment-connected-necklace system; and this remains whether the necklace is clasped in a continuous loop (joined together) or when unclasped (e.g., laid out). As the respective elements (or segments) in the necklace are joined together as disclosed herein each respective element (or segment) resists relative rotation with the next element (or segment) relative to the long axis (cephalocaudal) of the necklace, while allowing relative pivoting therebetween so as to accommodate a wearer/user's body layout through multi-sections. In this way, the exposed ornamental section (e.g., stone location or indicia location) remains continuously visible to appreciation and will not roll to contact the support surface (e.g., roll over).

Figure 6A:
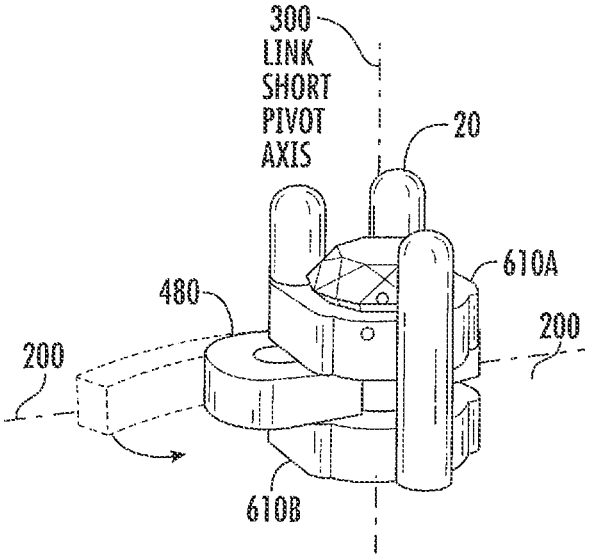
FIGS. 6A to 6I illustrate an exemplary ring link segment used in an exemplary segmented roll resistant necklace for the proposed invention.
Figure 6C:
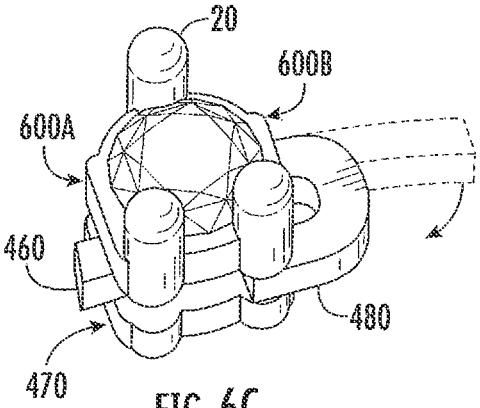
Figure 6B:
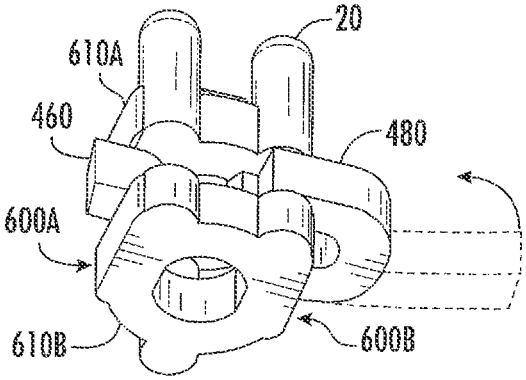
Figure 6D:
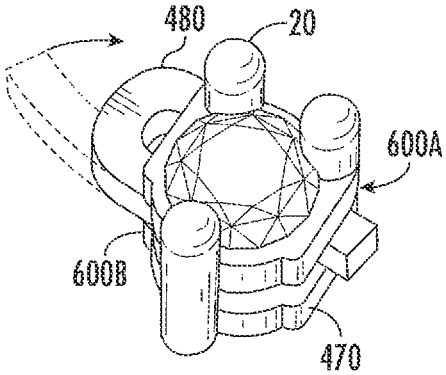
Figure 6E:
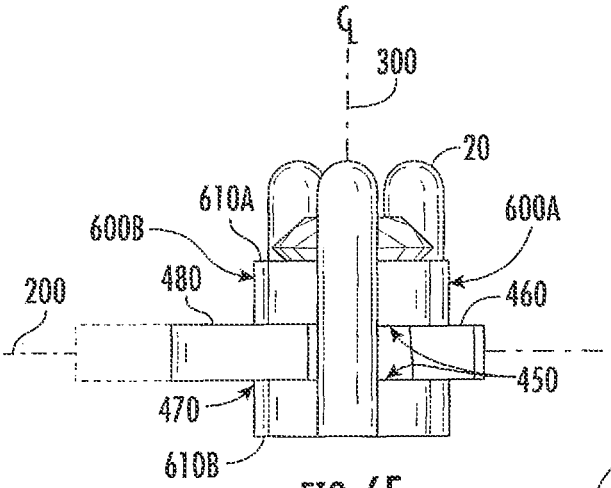
Figure 6F:
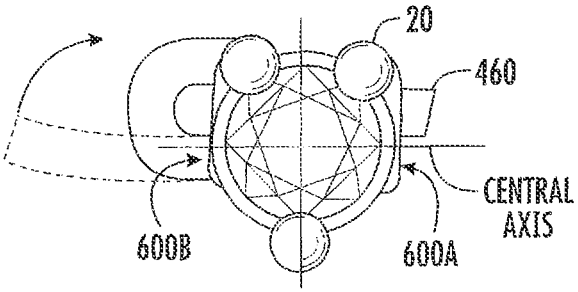
Figure 6G:
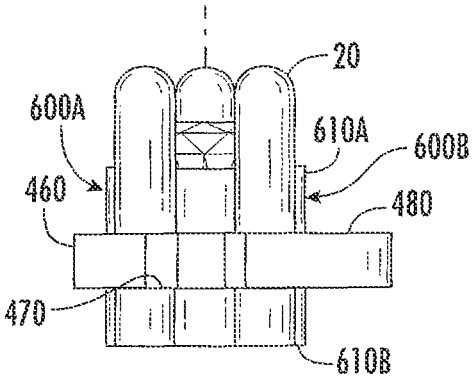
Figure 6H:
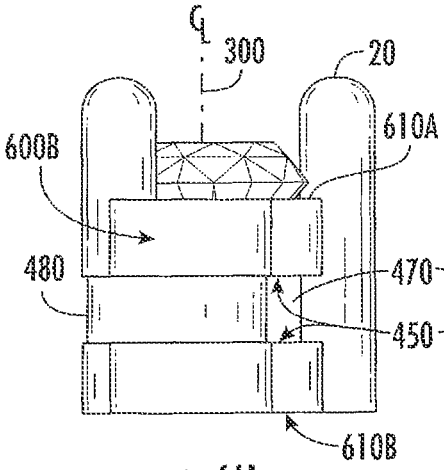
Figure 6I:
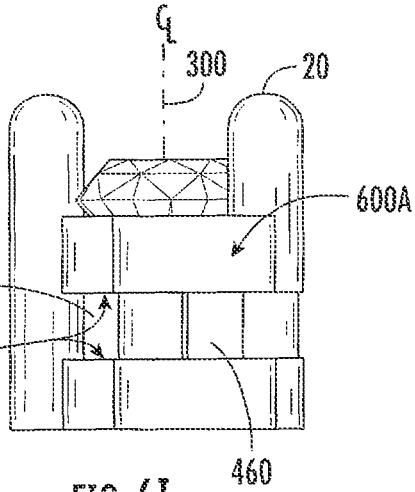
Figure 7A:
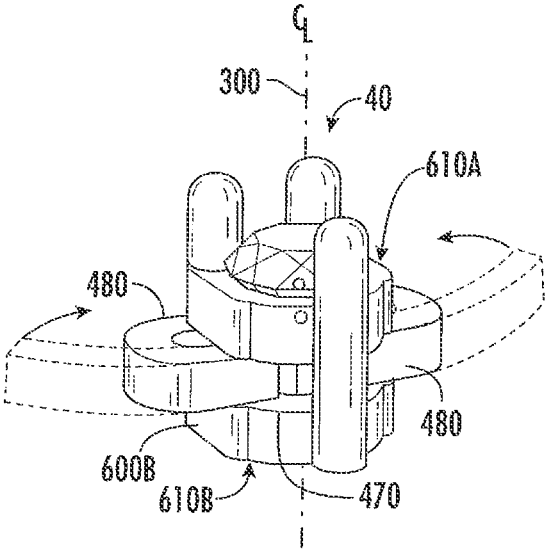
FIGS. 7A to 7H illustrate an exemplary dual ring link segment used to join and connect a converter link segment with a pull link segment in an exemplary segmented roll resistant necklace for the proposed invention.
Figure 7B:
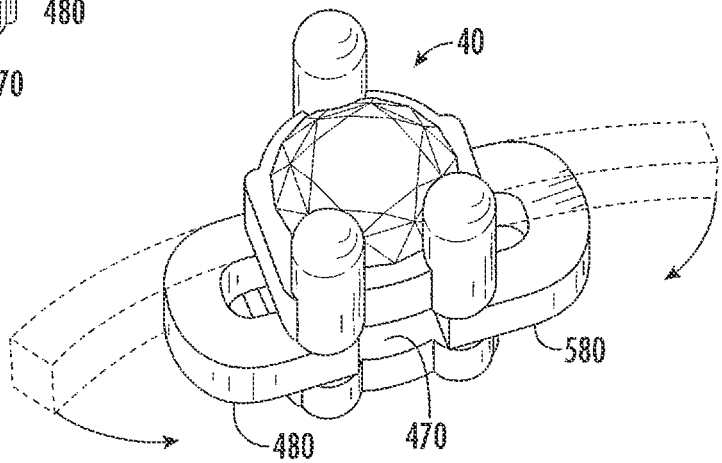
Figure 7C:
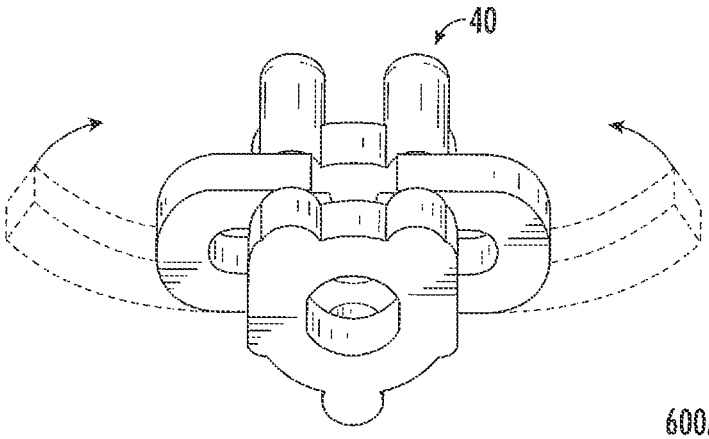
Figure 7D:
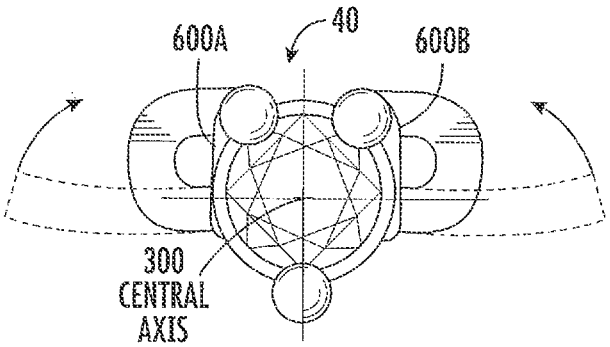
Figure 7E:
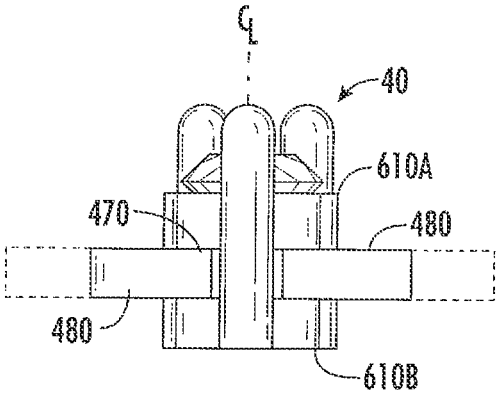
Figure 7F:
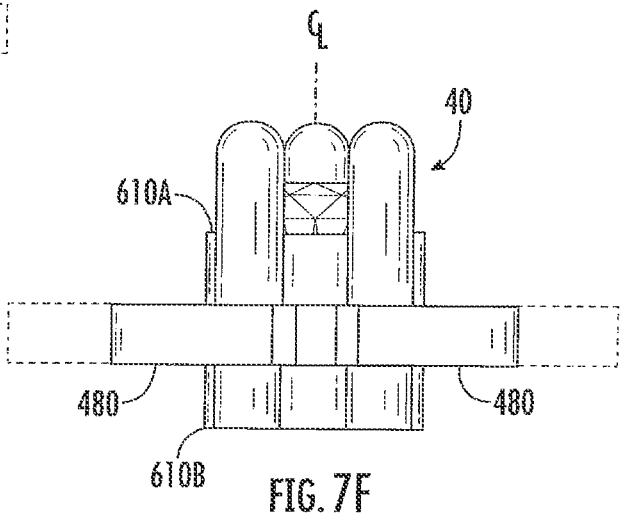
Figure 7G:
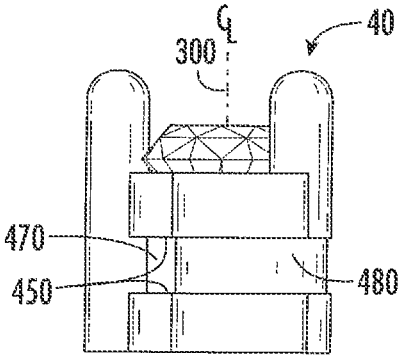
Figure 7H:
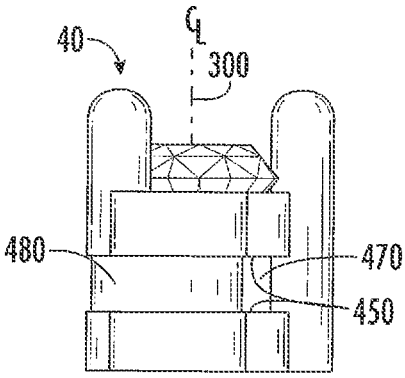
Figure 8A:
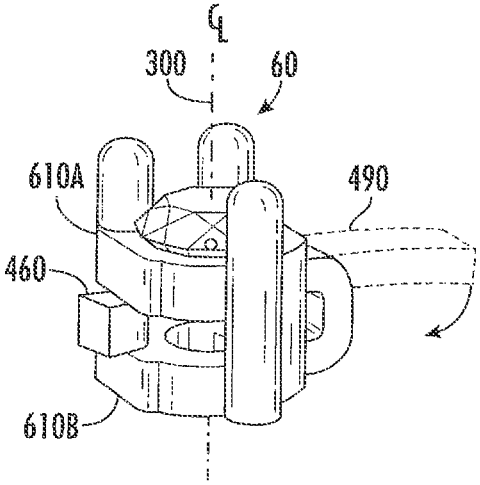
FIGS. 8A to 8G illustrate an exemplary converter link segment used to join and convert related segments in an exemplary segmented roll resistant necklace for the proposed invention.
Figure 8B:
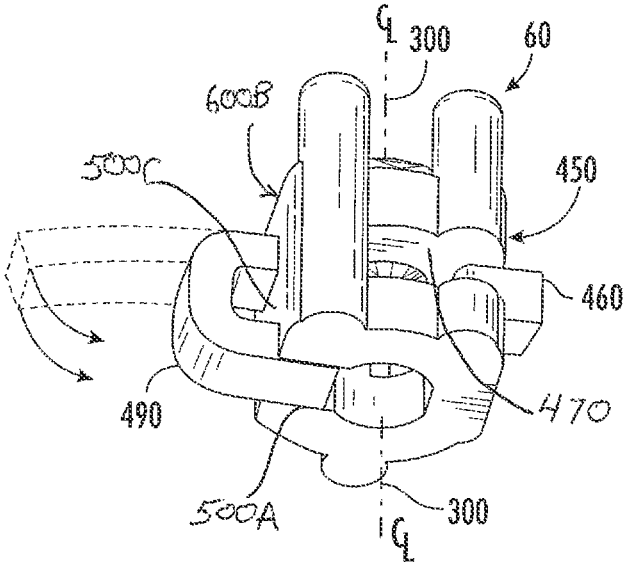
Figure 8C:
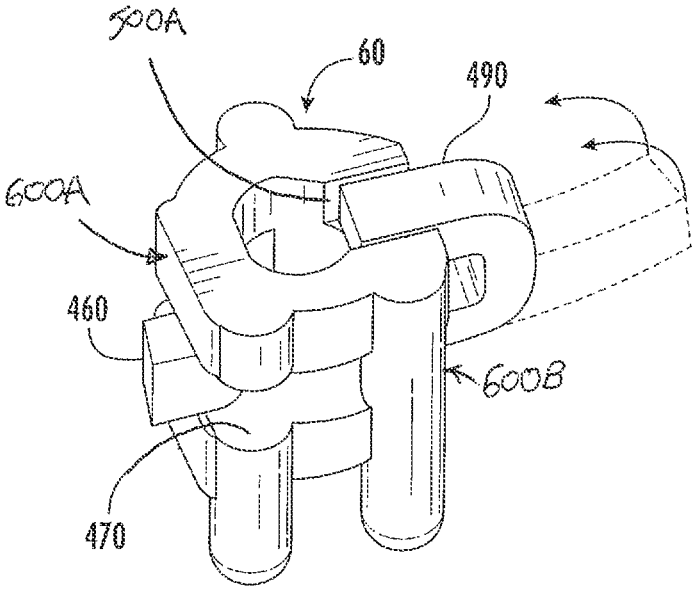
Figure 8D:
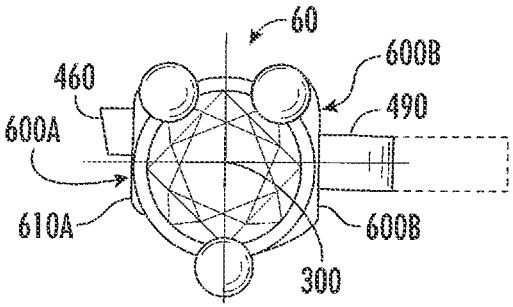
Figure 8E:
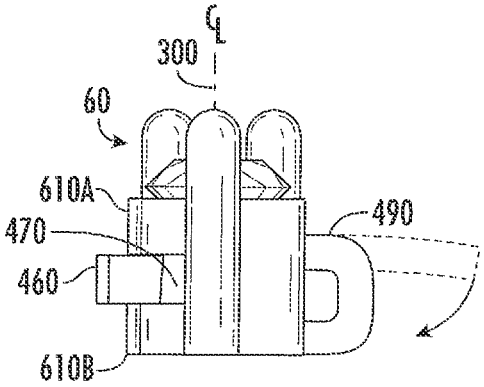
Figure 8F:
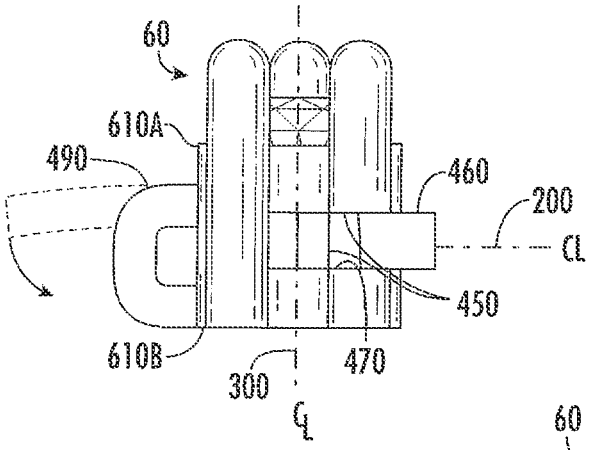
Figure 8G:
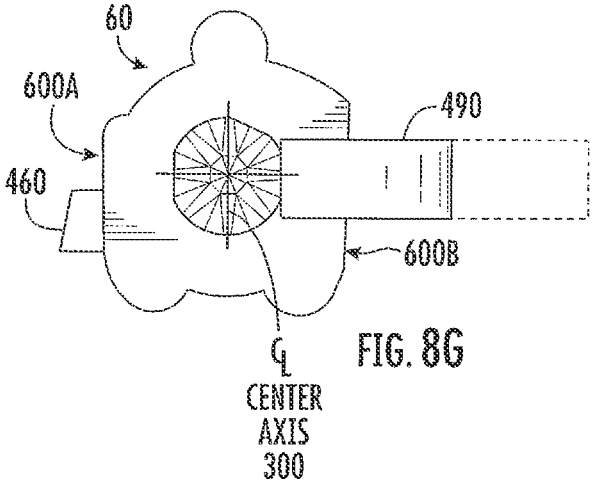
Figure 9E:
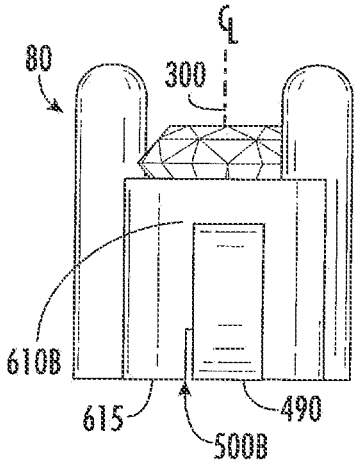
Figure 9F:
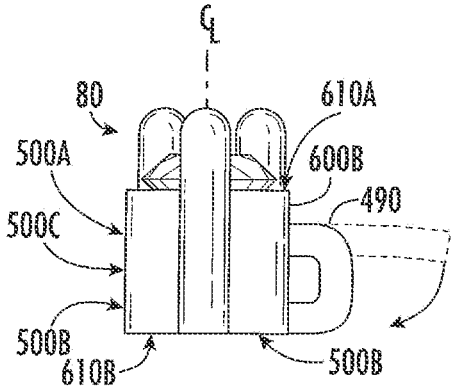
Figure 9G:
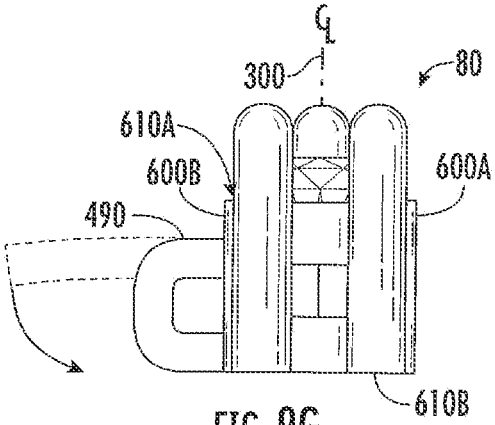
Figure 9H:
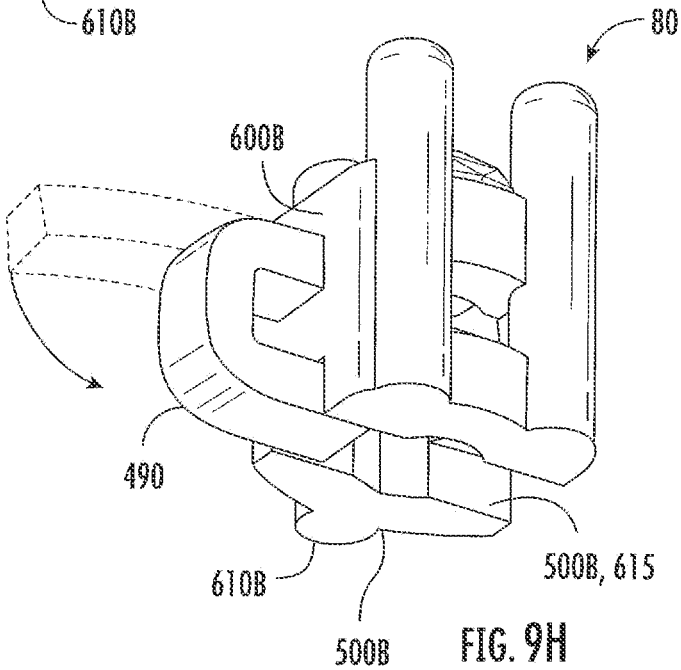

It will also be understood by those of skill in the art, having studied and appreciated the entire disclosure herein, that each of the respective links as used herein, including but not limited to ring links, dual ring links, converter links, pull links, clasp segments and transition assemblies may be provided additionally as the mirror images of the images shown, e.g., if a left ring link is shown in FIG. 6A then a mirror image right ring link (not shown) is to be understood as provided where the projections/brace/openings etc. are merely mirror images of those shown, without departing from the scope and spirit of the present invention.

It will be further understood by those of skill in the art, having studied and appreciated the entire disclosure herein, that the disclosure further includes the method of assembly of the segmented roll resistant necklace as disclosed herein, including the methods of bending link elements and joining link elements together to form the entire assembly, without departing from the scope and spirit of the present invention.

REFERENCE CHARACTERS

1000 Conventional segmented necklace
400 Segmented roll resistant necklace
200 Necklace long pivot axis (long axis)
300 Link short pivot axis (short axis)
110 Transition assembly (link assembly)
90 Clasp arrangement segment
80 Pull link
60 Converter link
40 Dual ring link
20 Ring link Having described at least one of the preferred embodiments of the present inventions with reference to the accompanying drawings, it will be apparent to those skilled that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents. To this end, those of skill in the is art having studied and appreciated the disclosure herein will understand that there is no restriction on the materials employed for any segment or indicia, or combinations of materials. For example, the segments may be metallic, and of any alloy, or nonmetallic and the indica may be of any nature (jewel, material, enamel, natural material, or otherwise) without limitation.

What is claimed is:

1. A segmented roll resistant necklace system, comprising:
- a clasp arrangement having a first clasp end and a second clasp end;
- a plurality of pull links secured to respective said first clasp end and said second clasp end and respectively extending away from said clasp arrangement to a respective transition assembly at the end of each of said plurality of pull links;
- each said transition assembly, further comprising:
  - a converter link connected to an end of said plurality of pull links;
  - a dual link connected to said converter link; and
- a plurality of ring links connecting each respective said dual link on each said transition assembly thereby forming said necklace assembly.

2. The segmented roll resistant necklace system, according to claim 1, further comprising:
- a pull link clasp segment on each of said first clasp end and said second clasp end; and
- said plurality of pull links extending from respective said first clasp end and said second clasp end.

3. The segmented roll resistant necklace system, according to claim 1, wherein:
- each said pull link, further comprises:
  - a brace hole on a first pull link contact side; and
  - a cantilever bar arm on a second pull link contact side.

4. The segmented roll resistant necklace system, according to claim 1, wherein:
- each said converter link, further comprises;
- a cantilever slot brace stub on a first converter link contact side; and
- a cantilever bar arm on a second converter link contact side.

5. The segmented roll resistant necklace system, according to claim 1, wherein:
- each said dual link, further comprises:
  - a first cantilever slot arm extending on a first dual link contact side; and
  - a second cantilever slot arm extending on a second dual link contact side.

6. The segmented roll resistant necklace system, according to claim 1, wherein:
- each said ring link, further comprises:
  - a cantilever slot brace stub on a first ring link contact side; and
  - a cantilever bar arm on a second ring link contact side.

7. A segmented roll resistant necklace system, comprising:
- a clasp arrangement having a first clasp end and a second clasp end;
- a plurality of pull links secured to respective said first clasp end and said second clasp end and respectively extending away from said clasp arrangement to a respective transition assembly at the end of each of said plurality of pull links;
- each said transition assembly, further comprising:
  - a converter link connected to an end of said plurality of pull links;
  - a dual link connected to said converter link;
- a plurality of ring links connecting each respective said dual link on each said transition assembly thereby forming said necklace assembly;
- a pull link clasp segment on each of said first clasp end and said second clasp end;
- said plurality of pull links extending from respective said first clasp end and said second clasp end;
- wherein each said pull link, further comprises:
  - a brace hole on a first pull link contact side; and
  - a cantilever bar arm on a second pull link contact side;
- wherein:
  - each said converter link, further comprises;
  - a cantilever slot brace stub on a first converter link contact side; and
  - a cantilever bar arm on a second converter link contact side;
- wherein each said dual link, further comprises:
  - a first cantilever slot arm extending on a first dual link contact side; and a second cantilever slot arm extending on a second dual link contact side;

wherein each said ring link, further comprises:

a cantilever slot brace stub on a first ring link contact side; and a cantilever bar arm on a second ring link contact side.

* * * * *